United States Patent [19]

Goto et al.

[11] 4,139,449

[45] Feb. 13, 1979

[54] ELECTROLYTIC CELL FOR PRODUCING ALKALI METAL HYPOCHLORITES

[75] Inventors: Nobutaka Goto; Michiru Naito, both of Tokyo, Japan

[73] Assignee: Chlorine Engineers Corp., Ltd., Tokyo, Japan

[21] Appl. No.: 871,166

[22] Filed: Jan. 20, 1978

[30] Foreign Application Priority Data

Feb. 17, 1977 [JP] Japan ..... 52-15497

[51] Int. Cl.[2] ..... C25B 9/00; C25B 11/03

[52] U.S. Cl. ..... 204/270; 204/278; 204/280; 204/284

[58] Field of Search ..... 204/270, 95, 277–278, 204/280, 284, 129

[56] References Cited

U.S. PATENT DOCUMENTS

| | | | |
|---|---|---|---|
| 3,755,105 | 8/1973 | Messner | 204/95 |
| 3,819,503 | 6/1974 | Casson et al. | 204/270 X |
| 3,849,281 | 11/1974 | Bennett et al. | 204/284 X |
| 3,892,653 | 7/1975 | Pacheco | 204/129 X |

*Primary Examiner*—John H. Mack
*Assistant Examiner*—D. R. Valentine
*Attorney, Agent, or Firm*—Sughrue, Rothwell, Mion, Zinn and Macpeak

[57] ABSTRACT

A process for producing an alkali metal hypochlorite which comprises electrolyzing an aqueous solution of an alkali metal chloride in an electrolytic cell including a plurality of unit cells, each equipped with at least one anode and at least one cathode, in which the unit cells are arranged in series via partitioning plates, wherein hydrogen gas generated at the cathode in each unit cell is passed out of each unit cell such that the hydrogen gas does not contact the cathode portion that takes part in electrolysis in the next adjacent unit cell and an electrolytic cell therefor.

10 Claims, 2 Drawing Figures

ELECTROLYTIC CELL FOR PRODUCING ALKALI METAL HYPOCHLORITES

BACKGROUND OF THE INVENTION

1. Field of the Invention

This invention relates to a process for producing alkali metal hypochlorites, especially sodium hypochlorite, and an electrolytic cell suitable for this process.

2. Description of the Prior Art

Alkali metal hypochlorites, especially sodium hypochlorite, are used as oxidizing agents for oxidizing treatment of water in order to sterilize, decolorize, and deodorize river water, city water, sewage water, waste water, etc., for iron elimination, and for manganese elimination of waste water from industrial establishments. When commercially available sodium hypochlorite is used, an aqueous solution of sodium hypochlorite usually having a concentration of 10 to 12% by weight must be transported to a water-treatment facility. Thus, about 7 to 9 times by weight of water to the sodium hypochlorite must be transported simultaneously. The cost of transportation is thus high, and moreover, the sodium hypochlorite partly decomposes or forms a chlorate due to the effect of temperature, impurities, sunlight, etc. during storage, and the concentration of available chlorine decreases. The reduction of the concentration of available chlorine is especially marked in the summertime, and generally about 25% of the available chlorine is lost.

To avoid this disadvantage, it is desirable to provide a non-diaphragm electrolytic cell at a site adjacent a water-treatment facility, and to produce an aqueous solution of an alkali metal hypochlorite efficiently in situ by electrolysis of an aqueous solution of an alkali metal chloride for use in water treatment or other purposes.

U.S. Pat. No. 3,849,281 is a recent approach to providing a means for on-site generation of alkali metal hypochlorite solutions and discloses a substantially vertical electrolytic cell containing a plurality of unit cells separated by horizontal partitions between the unit cells for electrolysis of alkali metal chloride aqueous solutions. However, in operation of the electrolytic cell described in U.S. Pat. No. 3,849,281, gas generated at the cathode in each unit cell contacts the cathode in the next adjacent unit cell, because cathodes are present in a passageway through which gas rises in the unit cells. This causes a marked increase of the electrical resistance of the electrolyte between the anodes and the cathodes and reduces the current efficiency of the electrolytic cell.

Thus, it is further desirable to reduce the operating cost suitably for water treatment by performing the electrolysis at high current efficiencies. In other words, an electrolytic cell which yields a large voltage with a small current capacity (one comprising a plurality of unit cells arranged in series) is preferred to increase the power efficiency (i.e., the conversion efficiency required for transformation and rectification) and reduce the cost of the equipment. For the unit cells, means to reduce the voltage of each unit cell and increase the current efficiency in each unit cell in an electrolytic cell must be provided.

SUMMARY OF THE INVENTION

Accordingly, an object of this invention is to provide a process for producing alkali metal hypochlorite at high conversion efficiency, low voltage and high current efficiency; and an electrolytic cell therefor.

According to a first embodiment of this invention, this invention provides a process for producing an alkali metal hypochlorite which comprises electrolyzing an aqueous solution of an alkali metal chloride in an electrolytic cell including a plurality of unit cells, each equipped with at least one anode and at least one cathode, in which the unit cells are arranged in series via partitioning plates, wherein hydrogen gas generated at the cathode in each unit cell is passed out of each unit cell such that the hydrogen gas does not contact the cathode portion in the next adjacent unit cell taking part in the electrolysis.

In a second embodiment, this invention provides an electrolytic cell comprising a plurality of vertically aligned unit cells each of which includes at least one anode and at least one cathode disposed horizontally therein, with the lowermost unit cell having an opening for the inflow of an electrolyte solution and the uppermost unit cell leading to an opening for the outflow of the electrolyte solution, the individual unit cells being partitioned by partitioning plates having an opening for the flow of the electrolyte solution; wherein the anode and the cathode have a structure which does not obstruct the upward movement of gas, for example, a foraminous structure such as a mesh, rod-type or perforated structure, each unit cell including a gas reservoir zone above the anode and the cathode, and the cathode part that takes part in electrolysis is not present in the passageway formed by the electrolyte flow openings in the cell partitions through which the gas rises in the unit cells through the electrolyte solution flow openings.

BRIEF DESCRIPTION OF THE ACCOMPANYING DRAWINGS

FIG. 1 is a sectional view of one example of the electrolytic cell of this invention, and FIG. 2 is a sectional view of another example of the electrolytic cell of this invention.

DETAILED DESCRIPTION OF THE INVENTION

In the production of an aqueous solution of an alkali metal hypochlorite using a non-diaphragm electrolytic cell, the following points should be mainly considered.

1. Reduction of the voltage of each unit cell:

To achieve a reduction of the voltage of each unit cell, a contrivance is made in the first and second embodiments of the present invention to pass the hydrogen gas, which is generated at the cathode and is a main cause of an increase in the electrical resistance of the electrolyte between the anode and the cathode, through that portion which is other than the interelectrode portion, and thereby to minimize the electrical resistance of the electrolyte solution between the electrodes.

2. Increase the current efficiency:

Various causes of a reduction in the current efficiency are conceivable. The main causes, however, are believed to be the following:

(1) The increase of the temperature within the cell causes hypochlorite ion to be chemically oxidized to chlorate ion.

(2) The hypochlorite ion is reduced on contact with the cathode. This reaction increases in proportion to the concentration of the hypochlorite ion in the electrolyte solution and the magnitude of the flow of the electrolyte solution on the interface of the cathode.

According to the first and second embodiments of the present invention, the resistance of the electrolyte solution between the electrodes, which is a cause of the temperature increase is minimized. Furthermore, in order to minimize the electrolyte solution flow on the interface of the cathode, the hydrogen gas generated is caused to pass through that portion which is other than the interelectrode portion thus minimizing the stirring effect by the hydrogen gas. According to the second embodiment of this invention, the electrolyte solution in a stationary state passes through a perforated cathode disposed horizontally, thereby to minimize the linear velocity of the electrolyte solution on the surface of the cathode. Moreover, in order to reduce the concentration of hypochlorite ion in the electrolyte solution in each unit cell and to finally obtain a high concentration of hypochlorite ion, the electrolyte solution is passed through unit cells in series in the electrolytic cell, and the average concentration of the hypochlorite becomes about half of that attained in the case of producing a high concentration hypochlorite ion by one pass through one unit cell. Hence, the current efficiency increases by about 10% in the present invention.

The present invention is described in more detail by reference to the accompanying drawings.

Figure 1:
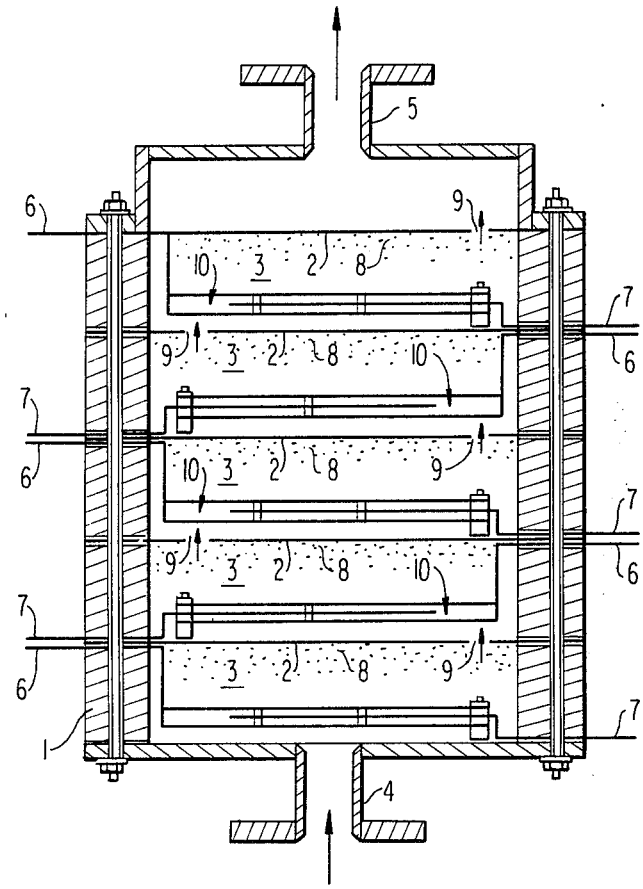

In FIG. 1, an electrolytic cell 1 comprises a plurality of unit cells 3 partitioned by partitioning plates 2. The walls of each of the unit cells and the partitioning plates are made of a corrosion resistant and electrically insulating material such as polyvinyl chloride, polypropylene, an acrylic resin, etc. The unit cell at the lowermost part leads to an opening 4 for the inflow of electrolyte solution, and the unit cell at the uppermost part, to an opening 5 for the outflow of electrolyte solution. An anode 6 and a cathode 7 are disposed horizontally in each unit cell. A suitable size for the electrolyte inflow opening 4 and the electrolyte outflow opening 5 can be, e.g., greater than one tenth of the cross sectional area of the unit cell. Both the anode and the cathode have a structure such that the upward flow of gas is not impeded, for example, a mesh-type, a rod-type or perforated-type plate-structure. Suitable anode materials which can be used include titanium coated with a platinum group metal oxide or titanium coated with a platinum group metal etc., and suitable cathode materials which can be used include iron, nickel, titanium, stainless steel, etc. The area of the cathode and the anode is not limited but will be determined in accordance with the cross-sectional area of the unit cell. Preferably the area is such that almost the whole cross-sectional area of the unit cell is convered. Each unit cell includes a gas reservoir zone 8 above the anode and the cathode. Each partitioning plate 2 has an opening 9 for the passage of the electrolyte. Desirably, in order to prevent current leakage, the electrolyte passage opening in one partitioning plate should be as far as possible from the electrolyte passage opening of the next partitioning plate. Gases generated on the electrodes (comprising mainly hydrogen gas) rise and gather at the upper portion of each unit cell. These gases, together with the electrolyte solution, pass upwardly through the openings 9 of the partitioning plates 2 in the unit cells, and flow out through the opening 5. It is important to ensure that there should be no cathode portion taking part in the electrolysis in the flow passageway of the gas when the gas, together with the electrolyte solution, rises in the unit cells through the openings 9 of the partitioning plates 2. Since as in the drawings, the cathode is not present at the portion 10, no cathodic reduction occurs at this portion.

In order to exclude the cathode portion from the gas passageway, it is also possible to insert the anode and the cathode parallel to each other in the unit cell from the same direction so that neither the anode nor the cathode is present in the gas passageway; or to use a cathode whose surface in the gas passageway is electrically insulated.

Figure 2:
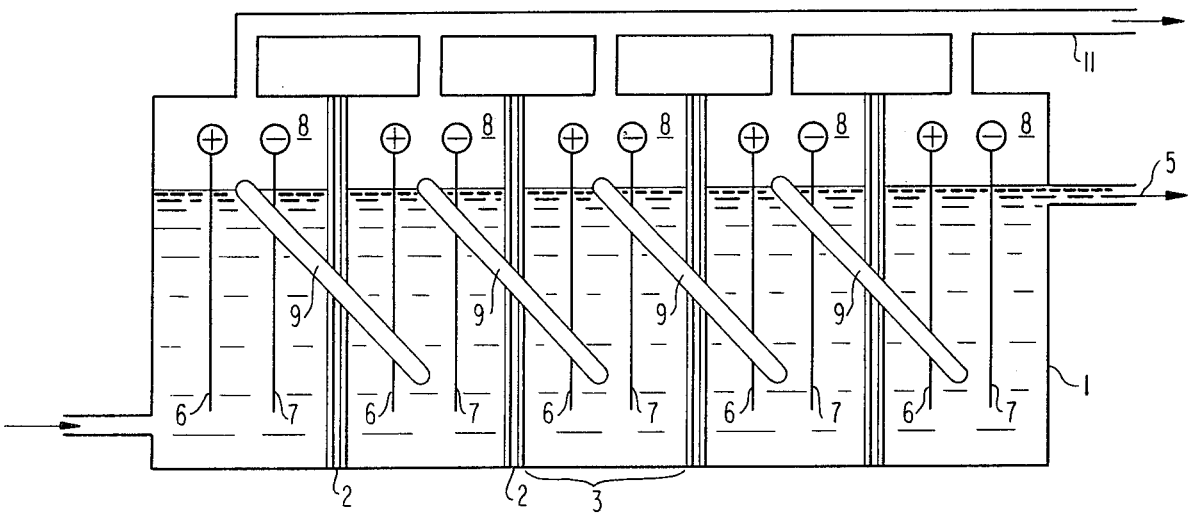

In FIG. 2, the unit cells are juxtaposed laterally, and the electrodes in each cell are disposed vertically. In this embodiment, hydrogen gas which gathers at the upper portion of each of the unit cells 3 partitioned by partitioning plates 2 is passed out through hydrogen gas outlet 11.

Since in this invention, gases generated on the electrodes rise and gather in the gas reservoir zone, and by the flowing of the electrolyte solution, rise in the electrolytic cell and finally flow out, the gases do not pass between the electrodes, but pass in a stationary state at a low linear velocity above the cathode surface, and thus, the current efficiency can be increased markedly. This makes it possible to economically operate the electrolytic cell to produce in situ alkali metal hypochlorites having many applications.

In the process of this invention and in the electrolytic cell of this invention, an aqueous solution of an alkali metal chloride such as sodium chloride, potassium chloride, lithium chloride, etc., particularly preferably sodium chloride, is used as a starting material. A suitable alkali metal chloride concentration in the aqueous solution is in excess of about 10 g/l, and preferably is about 20 to about 40 g/l. In general it is desirable to use a high purity alkali metal chloride, e.g., one having a purity in excess of about 95%. A suitable pH for the starting aqueous solution of the alkali metal chloride is about 5 to 10 and a suitable temperature for the aqueous solution of the alkali metal chloride is above about 5° C., preferably 20° to 45° C. The process of this invention can be conducted at a temperature of about 5° to about 60° C., preferably 5° to 45° C. using a voltage ranging from about 2.3 to 10 volts, preferably 4 to 5 volts. A suitable electrode current density which can be employed is less than about 50A/dm$^2$, preferably below 30A/dm$^2$, with a suitable electric capacity being below about 3A.hr/l, preferably 1 to 2A.hr/l. The process of this invention and the electrolytic cell of this invention can be used to produce alkali metal hypochlorites such as sodium hypochlorite, potassium hypochlorite and lithium hypochlorite. Production of sodium hypochlorite is particularly preferred commercially. The alkali metal hypochlorite is produced in a high concentration. In general when sodium hypochlorite is produced, the concentration will be in the range of about 5 g/l to about 15 g/l, preferably about 5 g/l to about 10 g/l (as available chlorine).

The following Example is given to further illustrate the process for producing an alkali metal hypochlorite by the present invention. Unless otherwise indicated herein, all parts, percents, ratios and the like are by weight.

EXAMPLE

An aqueous solution of sodium chloride was electrolyzed under the following conditions using a titanium anode coated with ruthenium oxide and a titanium cathode in a non-diaphragm electrolytic cell of the type shown in FIG. 1 which was made of polyvinyl chloride except for the electrode portions.

| Electrolysis Conditions | |
|---|---|
| Current Density at the Anode: | 15 A/dm$^2$ |
| Current Density at the Cathode: | 30 A/dm$^2$ |
| Concentration of Aqueous Electrolyte Solution of Sodium Chloride Fed: | 30 g/liter |
| Temperature of the Electrolyte: | 55° C |

As a result of the electrolysis, the hydrogen gas generated did not cover the cathode portion of each unit cell that took part in the electrolysis but flowed from the electrolyte solution-outlet opening together with the electrolyte solution.

The resulting sodium hypochlorite had an available chlorine concentration of 6580 ppm, and the current efficiency was 64.5%. Thus good results were obtained.

While the invention has been described in detail and with reference to specific embodiments thereof, it will be apparent to one skilled in the art that various changes and modifications can be made therein without departing from the spirit and scope thereof.

What is claimed is:

1. An electrolytic cell comprising a plurality of vertically aligned unit cells, each of which includes at least one anode and at least one cathode disposed horizontally therein, the lowermost unit cell having an opening for inflow of an electrolyte solution and the uppermost unit cell having an opening for the outflow of the electrolyte solution, the individual unit cells being partitioned by partitioning plates having an opening for the passage of electrolyte solution; wherein the anode and the cathode have a structure that does not obstruct the upward flow of gas, each unit cell including a gas reservoir zone above the anode and the cathode, and the cathode area that takes part in electrolysis is not present in a passageway through which the gas rises in the unit cells through the electrolyte solution flow openings.

2. The electrolytic cell of claim 1, wherein the anodes and the cathodes are mesh-type electrodes.

3. The electrolytic cell of claim 1, wherein the anodes and the cathodes are perforated plates.

4. The electrolytic cell of claim 1, wherein the anodes and the cathodes are rod-type electrodes.

5. The electrolytic cell of claim 1, wherein the anodes are mesh-type electrodes and the cathodes are perforated plates.

6. The electrolytic cell of claim 1, wherein the anodes are mesh-type electrodes and the cathodes are rod-type electrodes.

7. The electrolytic cell of claim 1, wherein the anodes are perforated plates and the cathodes are mesh-type electrodes.

8. The electrolytic cell of claim 1, wherein the anodes are perforated plates and the cathodes are rod type electrodes.

9. The electrolytic cell of claim 1, wherein the anodes are rod-type electrodes and the cathodes are mesh-type electrodes.

10. The electrolytic cell of claim 1, wherein the anodes are rod-type electrodes and the cathodes are perforated plates.

* * * * *